US006411207B2

(12) United States Patent
Shaffer

(10) Patent No.: US 6,411,207 B2
(45) **Date of Patent: *Jun. 25, 2002**

(54) PERSONAL ALERT DEVICE

(75) Inventor: Karl Richard Shaffer, Hialeah, FL (US)

(73) Assignee: Avaya Technology Corp., Basking Ridge, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/411,607

(22) Filed: Oct. 1, 1999

(51) Int. Cl.[7] ..... G08B 19/00; G08B 25/08

(52) U.S. Cl. ..... 340/521; 340/573.1; 340/691.1; 340/692; 340/691.6

(58) Field of Search ..... 340/521, 539, 340/692, 691.1, 691.6, 331, 573.1

(56) References Cited

U.S. PATENT DOCUMENTS 4,428,685 A * 1/1984 Lemelson et al. ..... 381/51
4,558,181 A * 12/1985 Blanchard et al. ..... 340/692
4,821,027 A * 4/1989 Mallory et al. ..... 340/539
5,088,056 A * 2/1992 McIntosh et al. ..... 340/309.15
5,349,338 A * 9/1994 Routman et al. ..... 340/692
5,460,228 A * 10/1995 Butler ..... 340/568

* cited by examiner

*Primary Examiner*—Donnie L. Crosland

(57) ABSTRACT

A personal alert device for a user includes a portable housing to be carried by the user, a processor in the housing, and at least one sensor connected to the processor for detecting a possible physical threat to the user. The processor generates an alert message relating to a recommended course of action for the user to avoid the possible physical threat. The alert message may be an audible speech message, and a visual message displayed on a display connected to the processor. Since a person can be exposed to a variety of physical threats on any given day, the personal alert device carried by the user provides reliable detection of a possible physical threat, and by generating an alert message the user receives a recommended course of action to avoid the possible physical threat.

38 Claims, 3 Drawing Sheets

"A STRONG THUNDERSTORM OR TORNADO IS APPROACHING. PLEASE TAKE COVER UNDER A STRONG SUPPORT STRUCTURE, SUCH AS A DOORWAY OR CLOSET AREA."

PERSONAL ALERT DEVICE

FIELD OF THE INVENTION

The present invention relates to the field of electronics, and, more particularly, to an electronic device including at least one sensor for alerting a user of a possible physical threat.

BACKGROUND OF THE INVENTION

On any given day, a person can be subjected to a variety of physical threats, such as an earthquake, a tornado, noxious gasses, fire, and even radiation, for example. Physical harm or injury to the person as a result of these types of physical threats can be avoided or at least minimized when a timely warning is provided to the person. Warning of a possible or potential threat may provide sufficient notice so that the person can take appropriate action to avoid the physical threat.

To adequately protect the person from such a variety of physical threats, multiple sensors are required. For example, a building structure typically includes a smoke detector for detecting a fire. An audible alarm is activated in response to the smoke detector detecting smoke so that the person is given notice to take precautionary measures, which is typically to evacuate the building structure. If the building structure is a large office building, for example, a prerecorded message may also be generated telling the person to exit the building through the closest stairway and avoid using the elevators.

The sensors are typically stationary sensors fixed to the building structure. Consequently, operation or even verification of their operation is typically outside of the person's control. A person must therefore rely on the maintenance personnel of the building structure or on the building inspectors to insure that the sensors are adequately working. If a particular sensor fails, then the person must use their own perception to detect the presence of a possible physical threat.

Since a person can be exposed to a variety of physical threats on any given day, there is a continuing need to provide reliable detection of a physical threat so that the person can avoid the detected physical threat.

SUMMARY OF THE INVENTION

In view of the foregoing background, it is therefore an object of the present invention to provide a personal alert device for a user which is under the user's control and which can be carried by the user.

This and other objects, features and advantages, in accordance with the present invention are provided by a portable alert device comprising a portable housing to be carried by the user, a processor in the housing, and at least one sensor connected to the processor for detecting a possible physical threat to the user. Moreover, the processor preferably generates an alert message relating to a recommended course of action for the user to avoid the possible physical threat. The alert message is an audible speech message in one embodiment.

In another embodiment of the present invention, the personal alert device includes a display, and the alert message may be a visual message displayed on the display. The personal alert device preferably further includes at least one of an audible and tactile transducer for notifying the user to view the display for the visual alert message. Since a person can be exposed to a variety of physical threats on any given day, the personal alert device carried by the user provides reliable detection of a possible physical threat, and by generating an alert message the user receives a recommended course of action to avoid the possible physical threat. The personal alert device is also under the user's control.

The at least one sensor may comprise one or more of an air pressure sensor, a noxious gas sensor, a temperature sensor, a radiation sensor, an accelerometer and an electrostatic sensor. Each of these sensors detects a possible physical threat to the user. For example, the air pressure sensor may detect a relatively rapid and sudden change in air pressure indicating an approaching thunderstorm.

The personal alert device preferably further includes a switch for selecting whether the alert message is audible, visual or both. Consequently, the alert message is preferably communicated to the user by a speaker carried by the housing of the personal alert device, or by the user viewing the display for the alert message.

In yet another embodiment of the present invention, the personal alert device includes a transceiver for communicating the alert message to a nearby user operating his own personal alert device. The alarm message is relayed to the nearby user, wherein the alarm message relates to a recommended course of action so that the nearby user can also avoid the possible physical threat. Networking among nearby personal alert devices advantageously allows a greater coverage area of the personal alert device for providing advance notice or warning to the user of a possible physical threat.

DETAILED DESCRIPTION OF THE PREFERRED EMBODIMENTS

Figure 1:
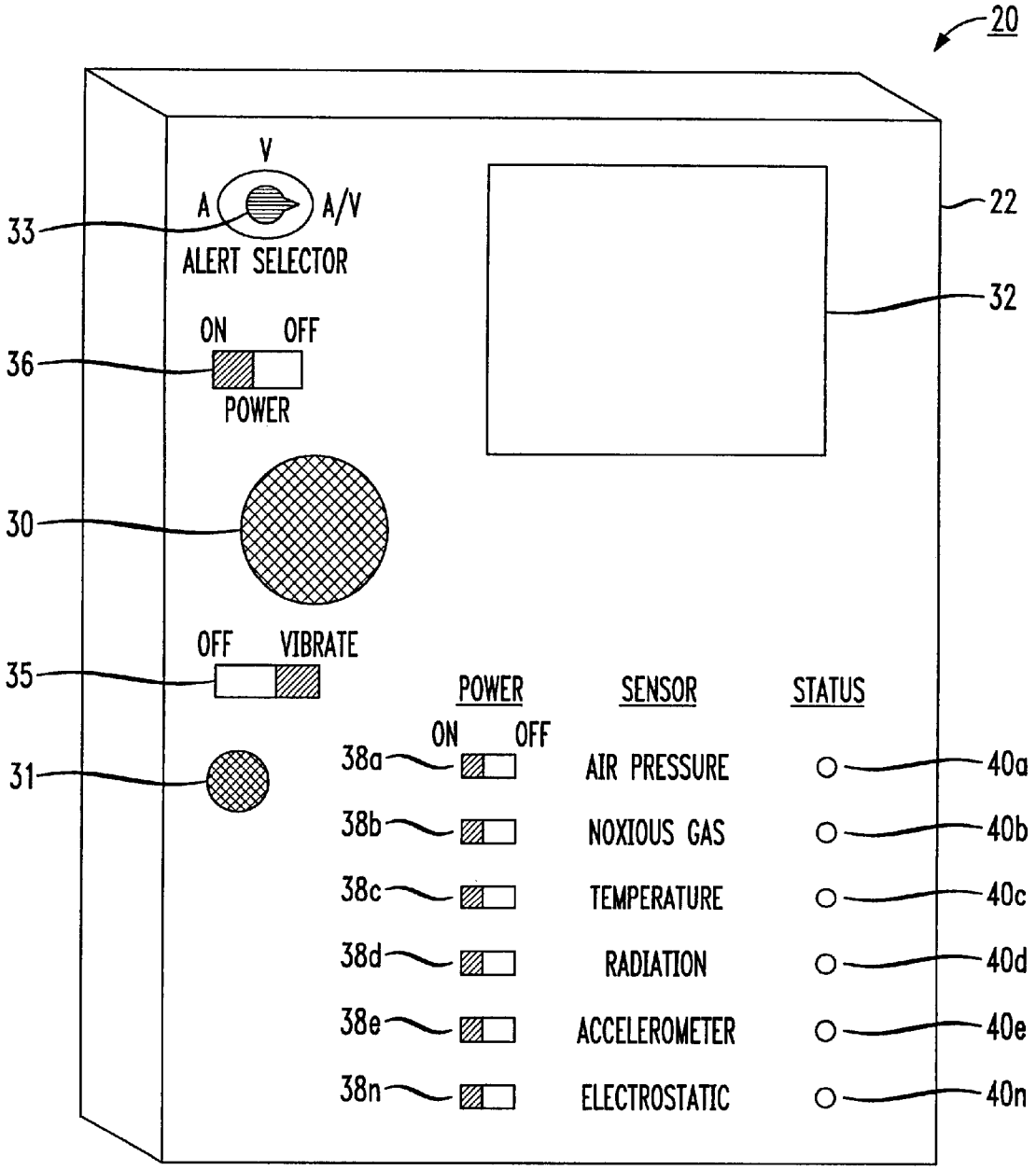
FIG. 1 is a perspective view of a personal alert device in accordance with the present invention.
Figure 2:
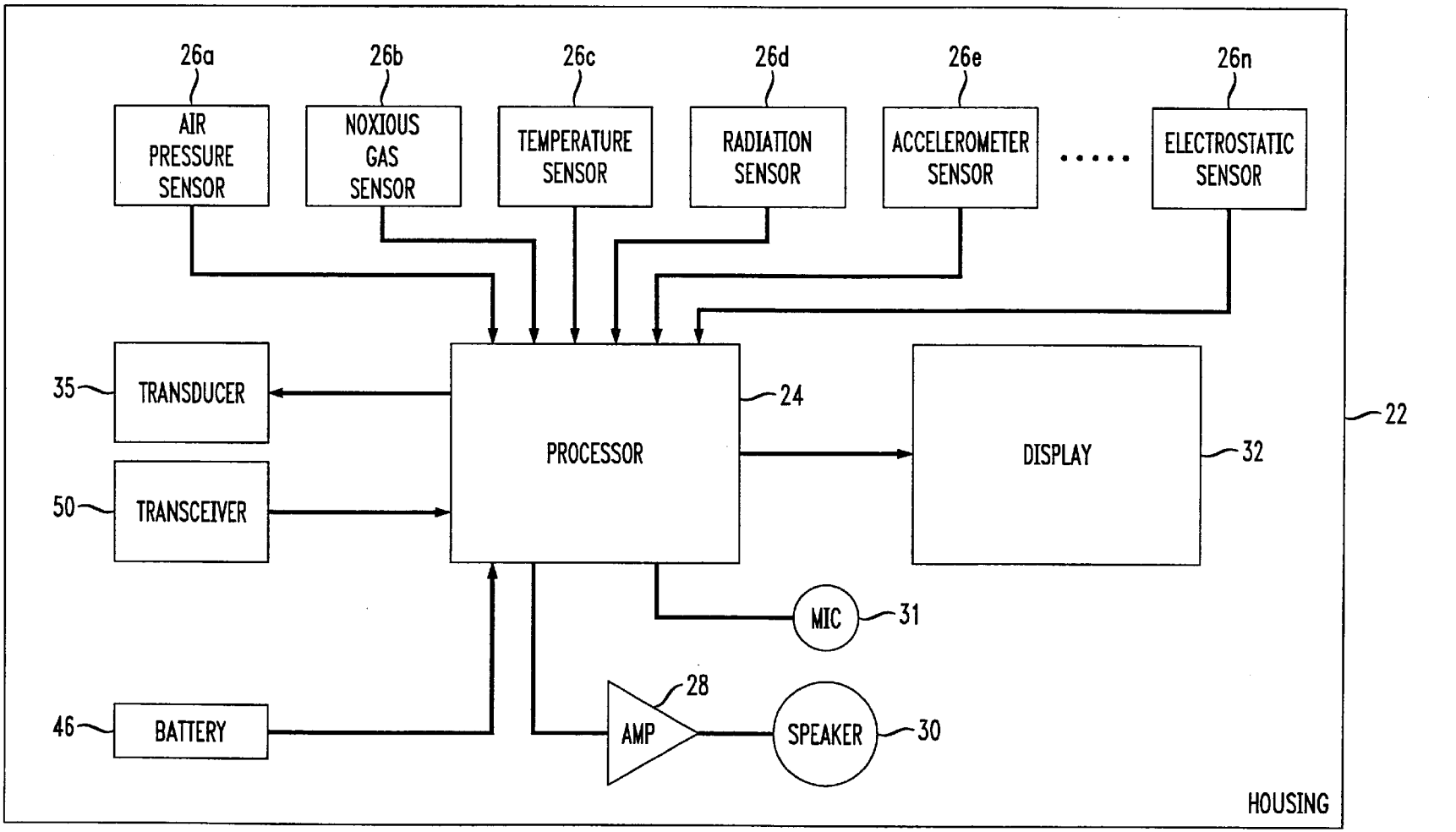
FIG. 2 is a block diagram of the personal alert device as shown in FIG. 1.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

A personal alert device 20 for detecting potential or possible physical threats to a user will be described with reference to FIGS. 1–4. In response to detecting a possible physical threat, the personal alert device 20 generates an alert message relating to a recommended course of action to the user to avoid the possible physical threat. The personal alert device 20 includes a housing 22 to be carried by the user, a processor 24 in the housing, and a plurality of sensors 26*a*–26*n* connected to the processor. Each sensor 26*a*–26*n* detects a particular possible threat and provides input to the processor 24 responsive thereto. The processor 24 generates the alert message relating to the recommended course of action for the user to avoid the possible physical threat.

The plurality of sensors 26*a*–26*n* illustratively include, but are not limited to, an air pressure sensor 26*a*, a noxious gas sensor 26*b*, a temperature sensor 26*c*, a radiation sensor 26*d*, an accelerometer 26*e* and an electrostatic sensor 26*n*. As will be explained in further detail below, each of these sensors 26*a*–26*n* detects a potential or possible threat and provides data input to the processor 24. Based upon a set of predefined thresholds, the processor 24 generates a respective alert message when anyone or a combination of these thresholds are exceeded.

In one embodiment, the alert message is an audible speech message generated by the processor 24, amplified by an amplifier 28, and delivered by a loud speaker 30 positioned in the housing 22.

The personal alert device 20 further includes a display 32 so that the alert message may be a visual message displayed on the display. The personal alert device illustratively includes a selector switch 33 for the user to select the desired type of alert message, i.e., audible, visual or both. When the alert message is a visual message, the personal alert device 20 may further include an audible or tactile transducer 35 for notifying the user to view the display 32. This feature of the invention is advantageous when the selector switch 33 is positioned to the visual only alert message position.

The personal alert device 20 is a portable device to be carried by the user. The personal alert device 20 can be carried by the user in his pocket, or may include a clip for attaching to the user's clothing. A battery 46 is carried by the housing 22 for powering the processor 24 and the sensors 26*a*–26*n*. The battery 46 may be a rechargeable battery. The personal alert device 20 may include an interface for an AC/DC converter for receiving power from an AC source, such as a 120 VAC.

The personal alert device 20 includes a master power switch 36 for activating the plurality of sensors 26*a*–26*n*. In addition, each of the sensors 26*a*–26*n* may include individual switches 38*a*–38*n* for disabling any one of the sensors. Adjacent each individual switch 34*a*–34*n* is a status indicator 40*a*–40*n* to indicate if the corresponding sensor 26*a*–26*n* is activated for detecting a possible physical threat.

Each of the sensors 26*a*–26*n* will now be discussed in greater detail, along with the alert message relating to the recommended course of action so that the user can avoid the possible physical threat. The following sensors 26*a*–26*n* listed herein are just some of many possible embodiments of the present invention. Moreover, the alert messages relating to the recommended course of action provided herein are examples and those of skill in the art will recognize that other similar messages are also contemplated by the invention. Since each of the following sensor types are readily known and understood by one skilled in the art, an in-depth analysis or discussion of their respective operation is not needed. In addition, each of the sensors 26*a*–26*n* may include an extension connected to or extending from the housing 22 for increasing sensitivity of a sensor for detecting a possible physical threat.

A first sensor 26*a* is an air pressure sensor for detecting a relatively rapid and sudden change in air pressure indicating an approaching thunderstorm, for example. The air pressure sensor 26*a* may include a thin silicon diaphragm which deforms in response to a pressure difference across it. The deformation produces two effects: a position-dependent displacement which is maximum at the diaphragm center, and a position-dependent strain which is maximum near the diaphragm edge. An electrical output signal may be generated in proportion to the differential pressure.

Figure 3:
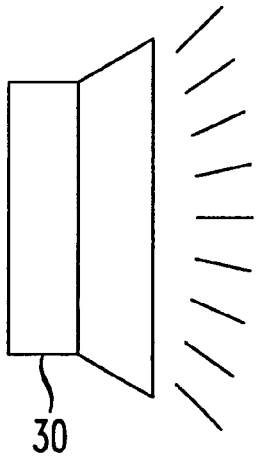
FIG. 3 is a portion of the block diagram of FIG. 2 illustrating a loud speaker generating an exemplary audible speech message relating to a recommended course of action in response to a detected physical threat.
Figure 4:
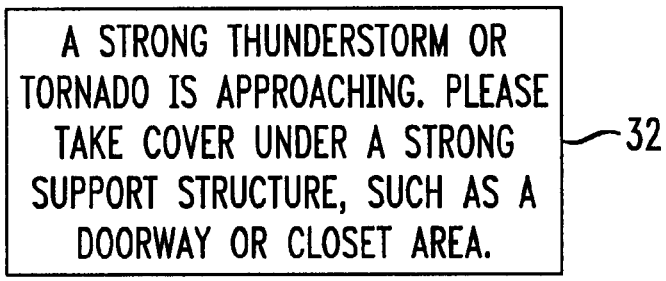
FIG. 4 is a display of an exemplary visual message relating to the recommended course of action in response to the detected physical threat in accordance with the present invention.

When the data input to the processor 24 provided by the air pressure sensor 26*a* exceeds a predefined threshold, the processor 24 generates an alert message relating to a recommended course of action for the user to avoid the possible physical threat. Referring now to FIGS. 3 and 4, the illustrated alert message is "A strong thunderstorm or tornado is approaching. Please take cover under a strong support structure, such as a doorway or closet area." The alert message is either an audible message as provided via the speaker 30 connected to the processor 24 (FIG. 3), or a visual message displayed on the display 32 (FIG. 4).

A second sensor 26*b* is a noxious gas sensor for detecting fire and hazardous chemicals. One example of a hazardous chemical is chlorine. Carbon monoxide is also detectable by the noxious gas sensor. The noxious gas sensor 26*b* may be more than one sensor providing these features, as readily appreciated by one skilled in the art. If smoke is detected, i.e., a fire is the possible physical threat, the alert message is "Smoke has been detected. Please evacuate the building. Do not take the elevator, use the stairway if necessary. Remain low to the ground if smoke is in the immediate area." This alert message can be either an audible message or a visual message. If the noxious gas sensor 26*b* had detected chlorine, the recommended course of action is: "Chlorine has been detected. Please get a wet cloth and cover you mouth." Likewise, if carbon monoxide is detected, the alert message is "Carbon Monoxide has been detected. Please move to an open area."

A third sensor 26*c* is a temperature sensor for detecting an abnormally high temperature, such as caused by a fire. The data input provided by the temperature sensor 26*c* may be correlated with the noxious gas sensor 26*b*. In other words, a fire would generate both smoke and heat, and the combination of these two data inputs would result in a reliable detection of the fire as the possible physical threat to the user. A fourth sensor 26*d* is a radiation sensor for detecting ionizing electromagnetic rays and/or particle radiation, e.g., x-rays and beta particles. The alert message is "You are being exposed to a high level of radiation. Please move to a different location."

A fifth sensor 26*e* is an accelerometer for detecting an earthquake or explosion. The recommended course of action may be similar to that provided by the air pressure sensor 26*a*. In one embodiment, the alert message is "An earthquake has been detected. Please move to an open area away from structures." If data input provided by the accelerometer sensor 26*e* correlates to an explosion, the recommended course of action is "An explosion has been detected. Please evacuate the building structure."

A sixth senor 26*n* is an electrostatic sensor for detecting strong electrostatic fields (ESF). Strong electrostatic fields may corresponds to impending lightening strikes or atmospheric conditions preceding a tornado. In this case, the alert message would be the same as that associated with the air pressure sensor 26*a*. Both of these conditions may also be accompanied by low atmospheric pressure detected by the air pressure sensor 26*a*.

Electrostatic fields are also generated by the compression of quartz material within the earth's crust when the ground moves. These fields are detectable near ground level and may be detected to warn of a possible earthquake. Earthquakes and tornados are also preceded by ultra low frequency (ULF) vibrations which may also be detected by the accelerometer sensor 26*e*.

Since there is an overlap by selected sensors (e.g., air pressure sensor 26*a*, accelerometer sensor 26*e* and electrostatic sensor 26*n*) for detecting different conditions corresponding to the same possible physical threat (e.g., lightening, tornado or earthquake), the processor 24 sorts out the various inputs and generates an appropriate alert message with the recommended course of action for the user to avoid the possible physical threat.

In another embodiment of the invention, the personal alert device 20 includes a transceiver 50 for communicating the alert message to a nearby user operating his own personal alert device. The alarm message is relayed to the nearby user, wherein the alarm message relates to a recommended course of action so that this user can also avoid the possible physical threat.

Networking among nearby personal alert devices advantageously allows a greater coverage area of the personal alert device 20 for providing advance notice or warning to the user of a possible physical threat. For example, if several personal alert devices detect noxious gases but at different times and with different intensities, a more detailed recommended course of action could be formulated by the processor 24. A more detailed recommended course of action may include which direction to travel to escape the detected physical threat. Location information may be provided by a global positioning system included in the personal alert device 20 or by a nearby base station networked with the personal alert device 20.

By sharing event information, it is more likely that a possible physical threat may be properly identified and an appropriate alert message is generated by the processor 24. Networking may be accomplished via a broadband local area network or a cellular network. The performance of the personal alert device 20 would be improved when networked with a base station, for example, which includes more sensitive sensors performing the same functions as the personal alert device.

Yet another sensor included within the personal alert device is a microphone 31 connected to the processor 24 for providing voice patterns to be analyzed by the processor 24. Based upon the analyzed voice patterns, stress in the speakers voice could be detected. When high levels of stress are detected, the processor 24 generates an alert such as "The speaker is highly stressed and may be prone to a violent action, or is lying. Please do not provoke any further.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed is:

1. A personal alert device for a user comprising:

a portable housing to be carried by the user;

a processor in said portable housing;

a plurality of sensors connected to said processor for detecting different types of possible physical threats to the user in a local environment of the user, the different types of possible physical threats capable of causing different types of physical harm or injury to the user; and said processor generating at least one local alert message relating to at least one recommended course of action for the user to thereby avoid physical harm or injury in response to the different types of detected possible physical threats from the local environment of the user.

2. A personal alert device according to claim 1, wherein the alert message is an audible speech message.

3. A personal alert device according to claim 1, further comprising a visual display; and wherein the alert message is a visual message on said display.

4. A personal alert device according to claim 3, further comprising at least one of an audible and tactile transducer for notifying the user to view said display.

5. A personal alert device according to claim 1, wherein said plurality of sensors comprises an air pressure sensor.

6. A personal alert device according to claim 1, wherein said plurality of sensors comprises a noxious gas sensor.

7. A personal alert device according to claim 1, wherein said plurality of sensors comprises a temperature sensor.

8. A personal alert device according to claim 1, wherein said plurality of sensors comprises a radiation sensor.

9. A personal alert device according to a claim 1, wherein said plurality of sensors comprises an accelerometer.

10. A personal alert device according to claim 1, wherein said plurality of sensors comprises an electrostatic sensor.

11. A personal alert device according to claim 1, wherein said plurality of sensors are selectably activated.

12. A personal alert device according to claim 1, further comprising a battery contained within said portable housing for powering said processor and said plurality of sensors.

13. A personal alert device according to claim 1, further comprising a transceiver for communicating with a nearby personal alert device.

14. A personal alert device according to claim 1, further comprising a microphone connected to said processor; and wherein said processor analyzes a user's speech pattern for stress.

15. A personal alert device for a user comprising:

a portable housing to be carried by the user;

a processor in said portable housing;

a plurality of sensors connected to said processor for detecting different types of possible physical threats to the user in a local environment of the user, the different types of possible physical threats capable of causing different types of physical harm or injury to the user; and a visual display connected to said processor;

said processor generating at least one local alert message relating to at least one recommended course of action for the user to thereby avoid physical harm or injury in response to the different types of detected possible physical threats from the local environment of the user, the alert message being an audible speech message and a visual message on said display.

16. A personal alert device according to claim 15, further comprising at least one of an audible and tactile transducer for notifying the user to view said display.

17. A personal alert device according to claim 15, wherein said plurality of sensors comprises an air pressure sensor.

18. A personal alert device according to claim 15, wherein said plurality of sensors comprises a noxious gas sensor.

19. A personal alert device according to claim 15, wherein said plurality of sensors comprises a temperature sensor.

20. A personal alert device according to claim 15, wherein said plurality of sensors comprises a radiation sensor.

21. A personal alert device according to claim 15, wherein said plurality of sensors comprises an accelerometer.

22. A personal alert device according to claim 15, wherein said plurality of sensors comprises an electrostatic sensor.

23. A personal alert device according to claim 15, wherein said plurality of sensors are selectably activated.

24. A personal alert device according to claim 15, further comprising a battery contained within said portable housing for powering said processor, said plurality of sensors and said display.

25. A personal alert device according to claim 15, further comprising a transceiver for communicating with a nearby personal alert device.

26. A personal alert device according to claim 15, further comprising a microphone connected said processor; and wherein said processor analyzes a user's speech pattern for stress.

27. A personal alert device for a user comprising:

a portable housing to be carried by the user;

a processor in said portable housing;

a plurality of sensors connected to said processor for detecting different types of possible physical threats to the user in a local environment of the user, the different types of possible physical threats capable of causing different types of physical harm or injury to the user;

a display connected to said processor;

said processor generating at least one local alert message relating to at least one recommended course of action for the user to thereby avoid physical harm or injury in response to the possible physical threats from the local environment of the user, the alert message being a visual message on said display; and at least one of an audible and tactile transducer for notifying the user to view said display.

28. A personal alert device according to claim 27, wherein the alert message is an audible speech message.

29. A personal alert device according to claim 27, wherein said plurality of sensors comprises an air pressure sensor.

30. A personal alert device according to claim 27, wherein said plurality of sensors comprises a noxious gas sensor.

31. A personal alert device according to claim 27, wherein said plurality of sensors comprises a temperature sensor.

32. A personal alert device according to claim 27, wherein said plurality of sensors comprises a radiation sensor.

33. A personal alert device according to claim 27, wherein said plurality of sensors comprises an accelerometer.

34. A personal alert device according to claim 27, wherein said plurality of sensors comprises an electrostatic sensor.

35. A personal alert device according to claim 27, wherein said plurality of sensors are selectably activated.

36. A personal alert device according to claim 27, further comprising a battery contained within said portable housing for powering said processor, said plurality of sensors and said display.

37. A personal alert device according to claim 27, further comprising a transceiver for communicating with a nearby personal alert device.

38. A personal alert device according to claim 27, further comprising a microphone connected to said processor; and wherein said processor analyzes a user's speech pattern for stress.

* * * * *